United States Patent [19]

de Cuadros

[11] 4,229,845

[45] Oct. 28, 1980

[54] COLLAPSIBLE HAMMOCK SUPPORT

[76] Inventor: Graciela V. O. de Cuadros, 9 de Octubre 836 (4to Piso), Guayaquil, Ecuador

[21] Appl. No.: 940,288

[22] Filed: Sep. 7, 1978

[51] Int. Cl.[2] ..... A45F 1/00

[52] U.S. Cl. ..... 5/127; 5/121; 5/114

[58] Field of Search ..... 5/92, 97, 121–130, 5/113; 135/8

[56] References Cited

U.S. PATENT DOCUMENTS

| | | | |
|---|---|---|---|
| 118,918 | 9/1871 | Evans | 5/127 |
| 1,062,950 | 5/1913 | Boss | 5/130 |
| 1,330,688 | 2/1920 | Demlinger | 5/129 |
| 1,784,240 | 12/1930 | Lynds | 5/129 |
| 2,586,247 | 2/1952 | Mover | 5/97 |
| 2,618,788 | 11/1952 | Cole et al. | 5/130 |

*Primary Examiner*—Casmir A. Nunberg

[57] ABSTRACT

Disclosed are two embodiments of a collapsible hammock support comprising (a) first and second ground-engaging support members for supporting a hammock at either end, said first and second ground-engaging support members being collapsible from a first, or use, position to a second, or travel, position; (b) at least one longitudinal bracing member carried by each ground-engaging support member and extending longitudinally from the ground-engaging support member by which it is carried on a first side thereof; (c) first means for detachably connecting said at least one longitudinal bracing member carried by said first ground-engaging support member to said at least one longitudinal bracing member carried by said second ground-engaging support member to form a rigid support for a hammock; (d) second means for detachably connecting one end of a hammock to the first side of said first ground-engaging member; and (e) third means for detachably connecting the other end of a hammock to the first side of said second ground-engaging member.

9 Claims, 2 Drawing Figures

COLLAPSIBLE HAMMOCK SUPPORT

TECHNICAL FIELD

This invention relates to outdoor furniture. In particular it relates to a collapsible, and hence portable, hammock support.

BACKGROUND OF PRIOR ART

While hammock supports are, of course, well known, I am aware of no collapsible, portable hammock support which provides the convenience of the two collapsible hammock supports disclosed herein.

BRIEF SUMMARY OF THE INVENTION

My invention is a collapsible hammock support comprising (a) first and second ground-engaging support members for supporting a hammock at either end, said first and second ground-engaging support members being collapsible from a first, or use, position to a second, or travel, position; (b) at least one longitudinal bracing member carried by each ground-engaging support member and extending longitudinally from the ground-engaging support member by which it is carried on a first side thereof; (c) first means for detachably connecting said at least one longitudinal bracing member carried by said first ground-engaging support member to said at least one longitudinal bracing member carried by said second ground-engaging support member to form a rigid support for a hammock; (d) second means for detachably connecting one end of a hammock to the first side of said first ground-engaging member; and (e) third means for detachably connecting the other end of a hammock to the first side second ground-engaging member.

DETAILED DESCRIPTION OF THE PRESENTLY PREFERRED EMBODIMENT

The First Embodiment

Figure 1:
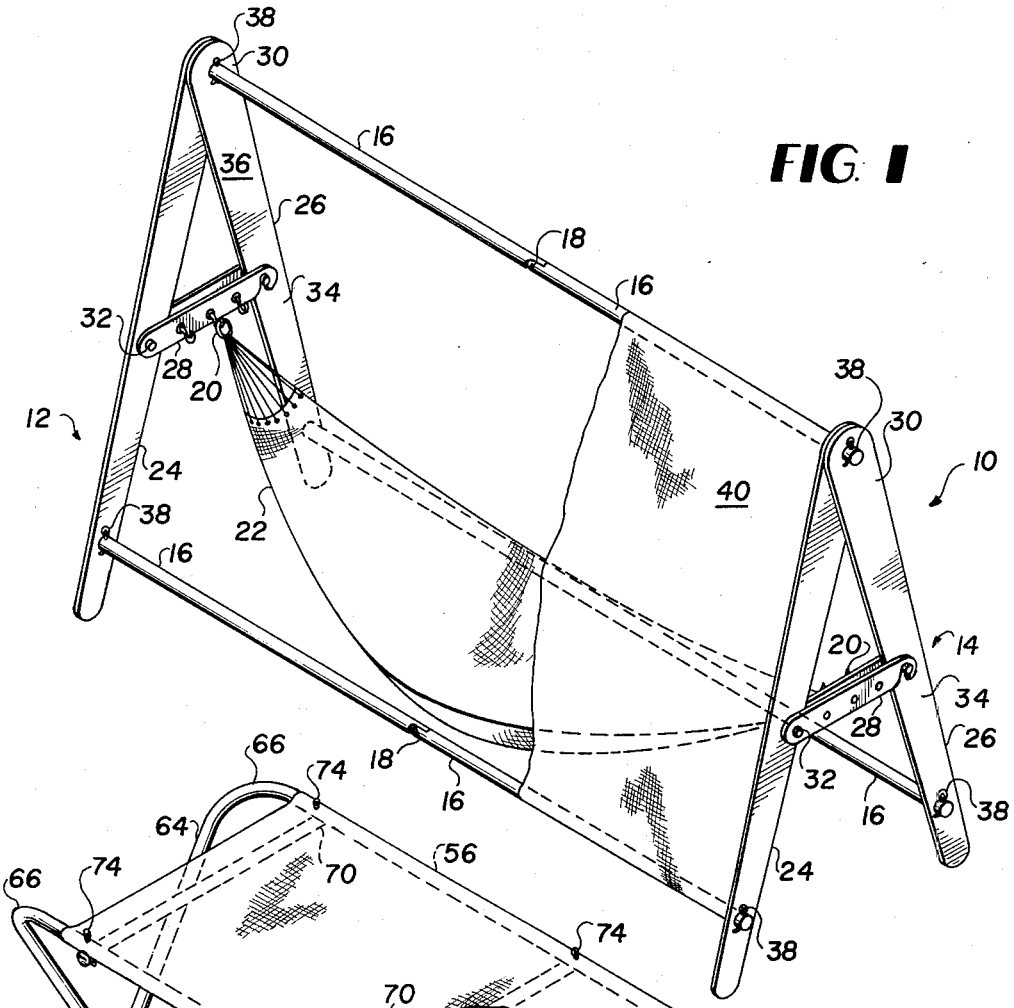
FIG. 1 is a perspective view of a first embodiment of my invention.

The collapsible hammock support 10 shown in FIG. 1 comprises a first ground-engaging support member 12, a second ground-engaging support member 14, a plurality of longitudinal bracing members 16, means 18 for connecting pairs of the longitudinal bracing members 16 to each other, and means 20 for detachably connecting a hammock 22 to the support members 12 and 14.

The support members 12 and 14 are collapsible from a first, or use, position shown in FIG. 1 to a second, or travel, position. Each of the support members 12 and 14 comprises an A-shaped structure comprising a first leg 24, a second leg 26, and a transverse bracing member 28. The first leg 24 and the second leg 26 are pivotably connected together at 30. The transverse bracing member 28 is pivotably connected to the first leg 24 at 32 and is detachably connected to the second leg 26 at 34. Accordingly, the transverse bracing member 28 can be detached from the second leg 26 and pivoted into alignment with the first leg 24, and the second leg 26 can be pivoted into alignment with the first leg 24 in order to collapse each of the support members 12 and 14 from their first position to their second position.

The longitudinal bracing members 16 are carried by each support member 12, 14 and extend longitudinally from the support members 12, 14 by which they are carried on a first side 36 thereof. They are detachably connected to the A-shaped structure by means of pairs of cotter pins 38, one passing through the bracing member 16 on each side of the support members 12, 14. One longitudinal bracing member 16 is connected to each A-shaped structure at the top of the A, and one bracing member 16 is connected to each A-shaped structure at the bottom of each leg 24, 26.

The means 18 which join the ends of each pair of bracing members 16 may be permanent pivots, as shown, or they may be detachable cotter pins.

The means 20 for detachably connecting the hammock 22 to the support means 12, 14 are preferably, as shown, a plurality of hooks spaced along the transverse bracing member 28.

An awning 40, at least the lower portions of which are preferably made from mosquito netting, is carried by the bracing member 16 in position to shade the hammock 22.

The Second Embodiment

Figure 2:
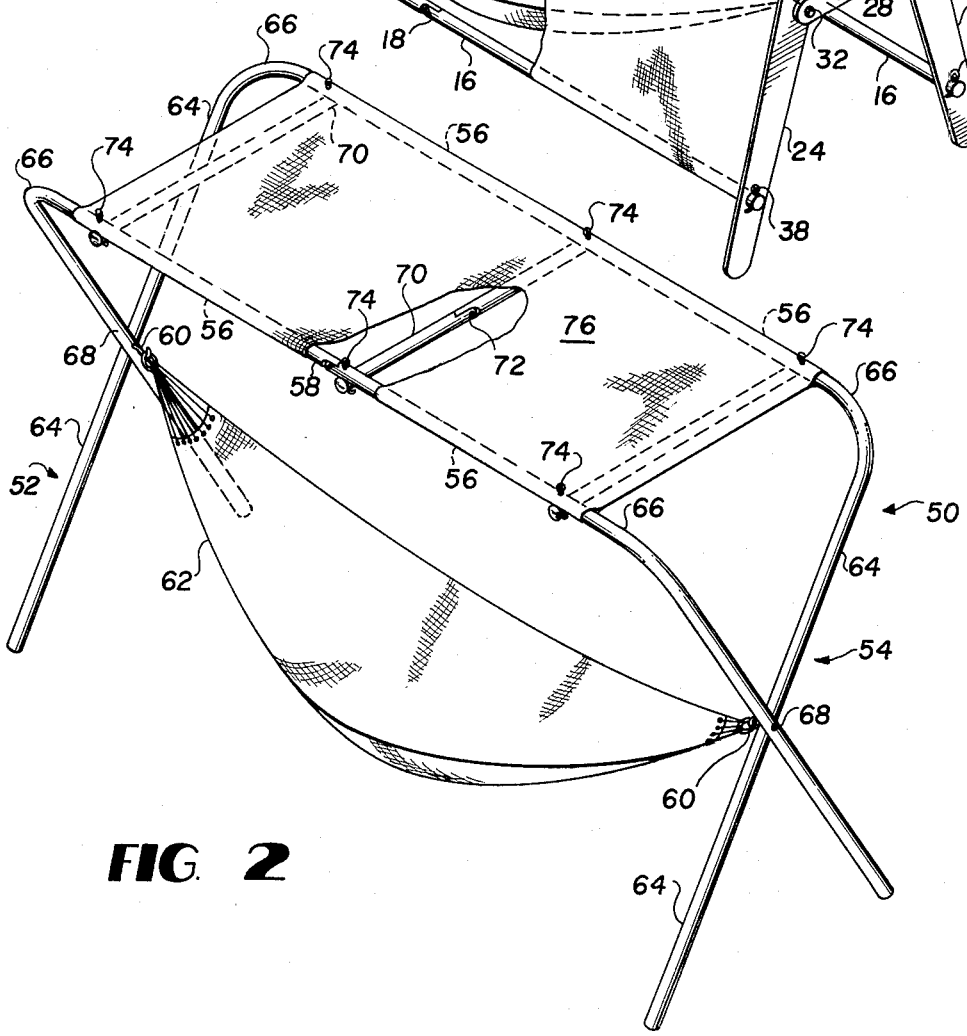
FIG. 2 is a perspective view of a second embodiment of my invention.

The collapsible hammock support 50 shown in FIG. 2 comprises a first ground-engaging support member 52, a second ground-engaging support member 54, a plurality of longitudinal bracing members 56, means 58 for connecting pairs of the longitudinal bracing members 56 to each other, and means 60 for detachably connecting a hammock 62 to the support members 52 and 54.

The support members 52 and 54 are collapsible from a first, or use, position shown in FIG. 2 to a second, or travel, position. Each of the support members 52 and 54 is integral with two longitudinal bracing members 56. Each of the support members 52, 54 and the two longitudinal bracing members 56 with which it is integral together comprise two L-shaped members each of which comprises a first leg 64 and a second leg 66 rigidly connected to each other. Each pair of L-shaped members is pivotably connected together at 68 intermediate the ends of the first legs 64. Accordingly, the L-shaped members can be pivoted into alignment with each other in order to collapse each of the support members 52, 54 from their first position to their second position.

Three transverse bracing members 70 are detachably connected at either end to the legs 66, thereby preventing pivoting of the two L-shaped members. One of the transverse bracing member 70 extends between two of the legs 66 adjacent their ends, and the two other transverse bracing members 70 extend between each pair of L-shaped member adjacent the connections between the legs 64 and 66. The transverse bracing members 70 are pivoted at 72 intermediate their ends to permit them to be folded up when the support members 52, 54 are collapsed from their first position to their second positions. The detachable connections between the transverse bracing members 70 and the legs 66 are effected by means of cotter pins 74.

The means 58 which join the ends of each pair of longitudinal bracing member 56 may be permanent pivots, as shown, or they may be detachable cotter pins.

The means 60 for detachably connecting the hammock 62 to the support means 52, 54 are preferably, as shown, hooks carried by the support means 52, 54 at the pivots 68.

An awning 76 is carried by the bracing member 56 in position to shade the hammock 52.

Caveat

It should be noted that, while the present invention has been illustrated by means of detailed descriptions of two preferred embodiments thereof, it will be obvious to those skilled in the art that various changes in form and detail can be made therein without departing from the true scope of the invention. For that reason, the inventor must be measured by the claim appended hereto and not by the foregoing preferred embodiments.

I claim:

1. A collapsible hammock support comprising:

(a) first and second ground-engaging support members for supporting a hammock at either end, said first and second ground-engaging support members each comprising an A-shaped structure comprising first and second legs which are pivotably connected together and a transverse bracing member which is pivotably connected to said first leg and which is detachably connected to said second leg, whereby said transverse bracing member can be detached from said second leg and said second leg can be pivoted into alignment with said first leg in order to collapse each of said first and second ground engaging support members from a first, or use, position to a second, or travel, position;

(b) three pairs of longitudinal bracing members, each longitudinal bracing member in each pair being connected to the other longitudinal bracing member in that pair by first means normally permitting relative pivotal motion between the two bracing members but permitting the user to selectively rigidify the two bracing members into a single rigid element, one pair of longitudinal bracing members being detachably connected to said A-shaped structures at the top of the A and at the bottom of each leg, whereby said longitudinal bracing member can be detached from said first and second ground-engaging support members and each pair of longitudinal bracing members can be pivoted into parallel, or travel, position; and (c) second and third means for detachably connecting one end of a hammock to adjacent side of said first and second ground-engaging support member, respectively.

2. A collapsible hammock support comprising:

(a) four L-shaped members each of which comprises first and second legs rigidly connected to each other, two of said L-shaped members being pivotably connected together intermediate the ends of said first legs to form first and second ground-engaging support members, respectively, for supporting a hammock at either end, whereby each pair of said L-shaped member can be pivoted into alignment with each other in order to collapse each of said first and second ground-engaging support members from a first, or use, position to a second, or travel, position;

(b) first means detachably rigidly connecting each L-shaped member in each ground-engaging support member to a corresponding L-shaped member in the other ground-engaging support member;

(c) at least one transverse bracing member detachably connected at either end to two of said second legs in one of said ground-engaging members, extends between them, and prevents relative pivoting of said ground-engaging member; and (d) second and third means for detachably connecting one end of a hammock to adjacent sides of said first and second ground-engaging support member, respectively, said second and third means being carried by said first legs where they are pivoted to each other.

3. A hammock support as recited in claim 1 and further comprising an awning carried by said bracing members in position to shade a hammock carried by said first and second ground-engaging members.

4. A hammock support as recited in claim 1 wherein the detachable connections between said longitudinal bracing members and said support members is effected by means of cotter pins.

5. A hammock support as recited in claim 2 wherein one transverse bracing member extends between two of said second legs adjacent their ends and two other transverse bracing members extend between each pair of L-shaped members adjacent the connections between the first and second legs.

6. A hammock support as recited in claim 5 wherein said transverse bracing members are pivoted intermediate their ends to permit them to be folded up.

7. A hammock support as recited in claim 5 wherein the detachable connections between said transverse bracing members and said L-shaped members are effected by means of cotter pins.

8. A hammock support as recited in claim 2 wherein said second and third means are hooks.

9. A hammock support as recited in claim 1 wherein said second and third means are a plurality of hooks spaced along said transverse bracing member.

* * * * *